United States Patent [19]

Russell

[11] 4,170,825

[45] Oct. 16, 1979

[54] SCALING PARALLEL BAR

[76] Inventor: Dudley W. Russell, 12307 Vanderheath, Houston, Tex. 77031

[21] Appl. No.: 869,516

[22] Filed: Jan. 16, 1978

[51] Int. Cl.[2] ..... B43I 13/02

[52] U.S. Cl. ..... 33/444

[58] Field of Search ..... 33/108, 80

[56] References Cited

U.S. PATENT DOCUMENTS

| | | | |
|---|---|---|---|
| 543,492 | 7/1895 | Laughlin et al. | 33/80 |
| 3,892,041 | 7/1975 | Adair et al. | 33/80 |
| 4,078,312 | 3/1978 | Byers | 33/80 |

FOREIGN PATENT DOCUMENTS

| | | | |
|---|---|---|---|
| 438807 | 12/1926 | Fed. Rep. of Germany | 33/80 |
| 867108 | 10/1941 | France | 33/80 |
| 1234909 | 5/1960 | France | 33/80 |
| 554875 | 6/1957 | Italy | 33/80 |
| 435584 | 9/1935 | United Kingdom | 33/108 |

*Primary Examiner*—Richard E. Aegerter
*Assistant Examiner*—John W. Shepperd
*Attorney, Agent, or Firm*—Browning, Bushman & Zamecki

[57] ABSTRACT

Disclosed is apparatus for determining distances along a direction in a plane. A base is constrained to translational movement along the direction by a guide system. An indicator is connected to the guide system to move relative to the base corresponding to movement of the base along the direction. In the particular embodiment disclosed, a parallel bar is provided with a moveable scale whereby the movement of the bar may be measured by determining the extent of movement of the indicator. A method disclosed for determining distances includes positioning a moveable scale in relation to a base equipped with an indicator identifying the position of the base. A reference marker may be used to identify the position along the scale the indicator is to assume when the base has been moved a desired distance.

10 Claims, 4 Drawing Figures

SCALING PARALLEL BAR

BACKGROUND OF THE INVENTION

1. Field of the Invention

The present invention pertains to apparatus and methods for determining distances along a direction in a plane. More particularly, the present invention relates to techniques for measuring, or marking off, distances on a plane or working surface such as a drafting table or drawing board. While the present invention is particularly applicable to the drafting arts, any activity requiring precise determination of distances along a direction in a plane will find the present invention useful.

2. Description of Prior Art

Drawing tools and drafting machines, many well known in the art, have been devised for facilitating the positioning and construction of lines or figures in drafting procedures. In some cases, such equipment is intended merely to provide more efficient means for carrying out construction on the drafting table which could otherwise be achieved by the use of such implements as a T-square, protractor, scales, and combinations of triangles. Typically, distances along a drafting table are determined by first constructing a line along the direction in question. A scale is then positioned along the line, and particular distances, or points, are located on the scale and corresponding marks are constructed on the line.

U.S. Pat. No. 3,835,542 discloses a drafting instrument for use in constructing a plurality of parallel lines as well as a plurality of radial lines. A device to aid in the construction of section lines in a drawing is disclosed in U.S. Pat. No. 1,832,112. Again, a plurality of parallel lines may be constructed with the latter device, with their relative spacing, at least along one direction, ascertainable by use of a scale included in the device. U.S. Pat. No. 1,977,213 discloses an improvement to a printer's line-up table. There, the usual carriage carrying a straight edge for positioning along the table may be locked in place at a finite number of locations. The improvement lies in providing a further horizontal movement for the straight edge in the form of a fine adjustment equipped with a scale to indicate the degree of additional movement of the straight edge.

SUMMARY OF THE INVENTION

Apparatus of the present invention provides a base constrained to translational movement along a predetermined direction. An indicator is connected to guide means, which so constrain the base, such that movement of the base is accompanied by corresponding movement of the indicator relative to the base. Such movement of the indicator relative to the base may be measured by means of a scale. The scale may be mounted on the base on a way or track system, which constrains movement of the scale to parallel the movement of the indicator relative to the base. A selectively moveable reference device is also provided, and constrained to movement along the base parallel to that of the indicator.

In a particular embodiment, the base is a parallel bar constrained for movement on a working surface, such as a drafting table, by guide means which limit the parallel bar to translational movement back and forth along a straight line in the plane of the working surface. Thus, the base is prevented from rotating relative to the direction of the line. Specific guide means may include wire segments, or other flexible lines, anchored to the working surface but which pass along the base and are guided relative thereto by sheaves.

An indicator is joined to one of the line segments and positioned so that movement of the base along the direction is accompanied by movement of the indicator along the base. A track system on the base may be used to guide the indicator. Also, a scale, moveable along the track system, is provided for measuring distances along the base.

In a method of the invention, a base is provided and constrained by guide means to translational motion along a straight line on a working surface. An indicator is also provided, joined to the guide means so that motion of the base along the direction of the line is accompanied by motion of the indicator relative to the base. A moveable scale is provided which is constrained to motion paralleling that of the indicator relative to the base. Also, a reference marker is provided selectively moveable along the base parallel to the movement of the indicator. The base is located at a desired reference position on the working surface. The scale is then positioned with a "0" reference point aligned with the indicator. The reference marker is then moved along the scale to the position indicating the desired location on the working surface to be reached by the base. The base is then moved along the working surface until the indicator is aligned with the reference marker.

DESCRIPTION OF PREFERRED EMBODIMENTS

Figure 1:
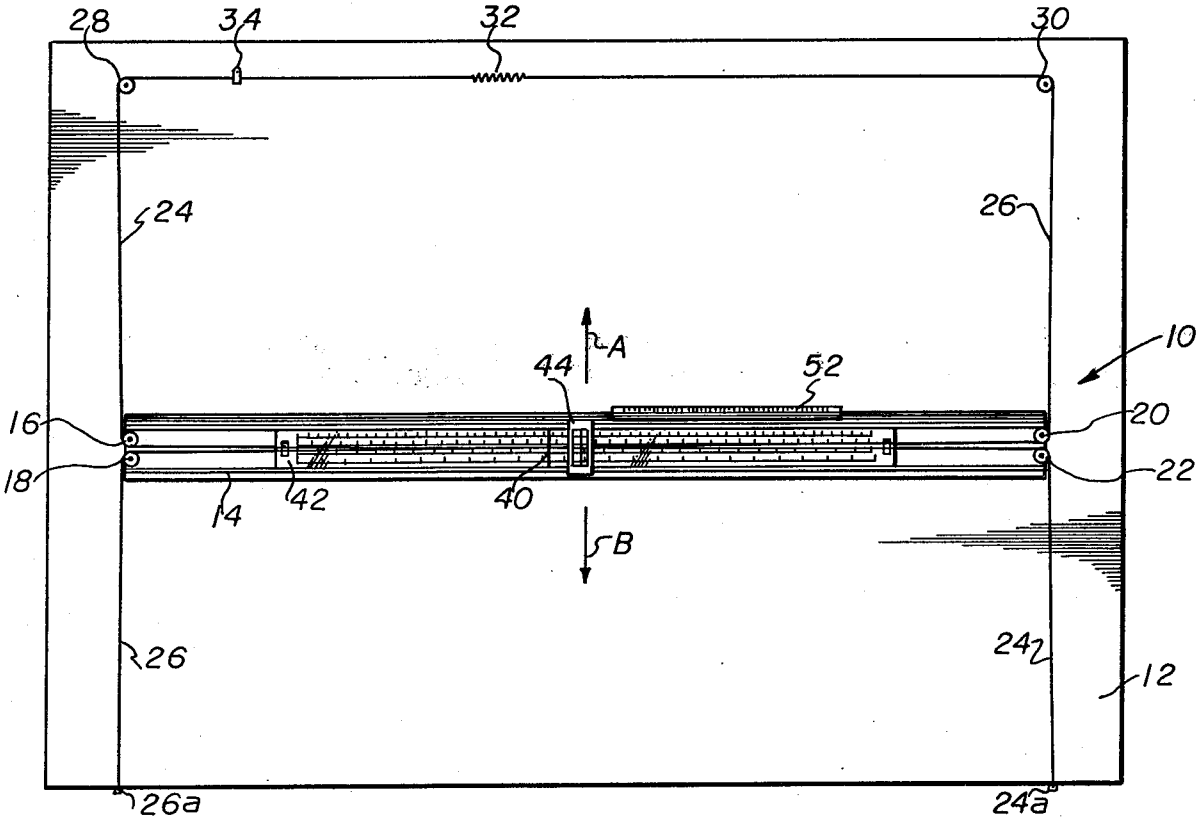
FIG. 1 is a plan view of a working surface with a scaling parallel bar of the present invention mounted thereon.
Figure 2:
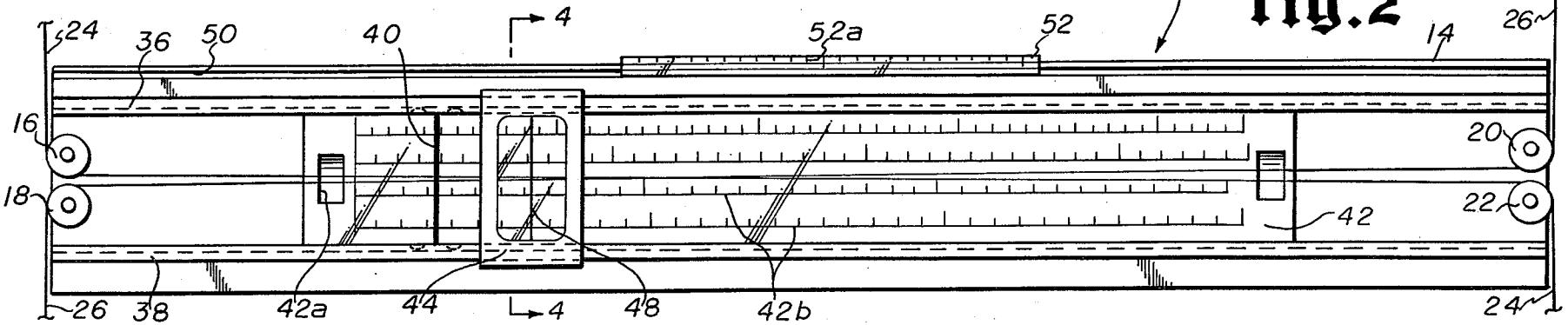
FIG. 2 is an enlarged plan view of the scaling parallel bar.
Figure 3:
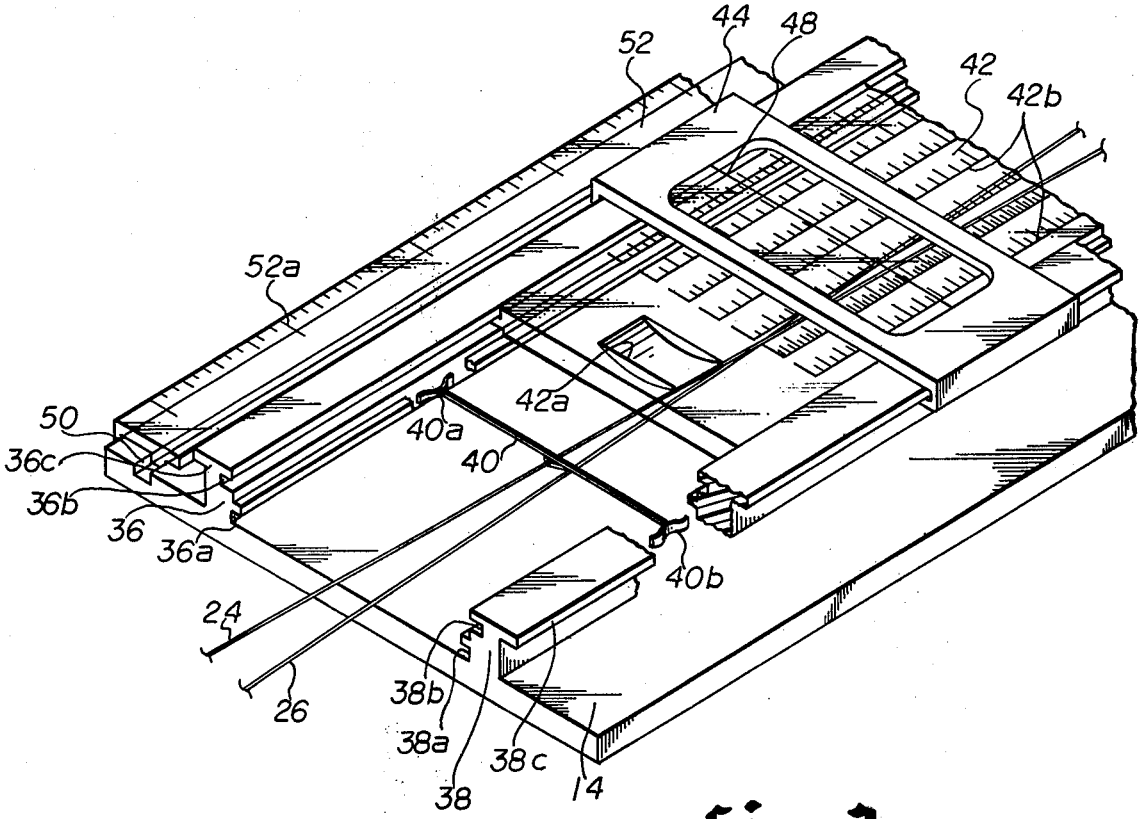
FIG. 3 is a perspective view, partially broken away, of a segment of the scaling parallel bar.
Figure 4:
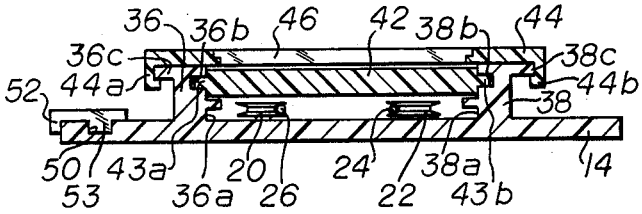
FIG. 4 is a cross-sectional view taken along 4—4 of FIG. 2.

A scaling parallel bar according to the present invention is shown generally at 10 in FIGS. 1 and 2, with details more readily visible in FIGS. 3 and 4. The parallel bar at 10 is shown in FIG. 1 mounted on a working surface 12, such as a drafting table or drawing board. A base 14 is fitted with wheels or sheaves 16, 18, 20, and 22 mounted on appropriate axels. A guide system, including wires, or other types of flexible lines, constrains the base 14 to nonrotative, translational motion back and forth along a direction, or line, on the plane of the working surface as indicated by the arrows A and B.

The guide system includes line segment 24 which passes around sheave 16, along the base 14 and around sheave 22, and is anchored at the edge of the working surface 12 at point 24*a*. A second line segment 26 passes around sheave 20, along the base 14 and around sheave 18, and is anchored to the working surface 12 at point 26*a*. Toward the opposite edge of the working surface 12, line 24 passes around a sheave 28, and is joined to line 26, which passes around sheave 30, by a spring 32. Both sheaves 28 and 30 are mounted on the working surface 12. Once the direction A-B along which the base 14 is to be constrained to move has been determined, the orientation of the base relative to the direction A-B is adjusted by movement of the line segments 24 and 26 around the sheaves 28 and 30. With the sheaves 16-22 symmetricaly positioned on the base 14, the base will move only in a direction perpendicular to its own longitudinal axis. A clip 34 anchors the line segment 24 to the working surface 12 once the desired orientation of the base 14 has been achieved. The orientation of the base 14 perpendicular to the line A-B is thus fixed, and the base is constrained to movement along the direction A-B. The spring 32 maintains a desired tension in the line 26 while providing a degree of resilliancy to cushion any momentary excess strain on the line 26.

As may be seen in FIGS. 3 and 4, the base 14 features a track system including track elements 36 and 38. Each of the track elements 36 and 38 is constructed to provide a pair of groove ways as well as to provide a flange way. Corresponding ways of the two track elements 36 and 38 cooperate to constrain the movements of specific components described hereinafter. A first way system is provided by grooves 36*a* and 38*a*. Grooves 36*b* and 38*b* cooperate to form a second way system. A third way system is provided by flanges 36*c* and 38*c*.

An indicator device 40 is connected to line segment 24, and is constrained by the first way system of grooves 36*a* and 38*a*. Springs 40*a* and 40*b* at the ends of the indicator 40 ride in the grooves 36*a* and 38*a*, respectively. As the base 14 is moved back and forth along the working surface 12, the point on the line segment 24 at which the indicator 40 is connected moves along the base, propelling the indicator along the first way system. Thus, movement from one position to another of the base 14 along the working surface is reflected by corresponding movement of the indicator 40 from one position to another along the base.

A sliding scale 42 is constrained to movement along the second way system of grooves 36*b* and 38*b* with tongues 43*a* and 43*b* riding in the grooves (FIG. 4). A carriage 44 is constrained to movement along the third way system of flanges 36*c* and 38*c*. Thus, with all three way systems running mutually parallel along the base 14, movement of the scale 42 as well as that of the carriage 44 is constrained to parallel the possible motion of the indicator 40.

The scale 42 is shorter than the length of the base 14, and may be typically approximately ⅔ the length of the base. Depressions 42*a* may be provided for grasping the scale 42 for ease of movement of the scale along the base 14. A plurality of engineering, architectural, or other measuring scales 42*b* may be engraved, or otherwise marked, on the scale 42. Thus, a choice of measuring scale is provided, with any one selected for use as desired. The scale 42 is constructed of a transparent material, such as glass or plexiglass, making the indicator 40 below clearly visible through the scale. In this way, the position of the indicator 40 along the base 14 and, therefore, along the scale 42 may be readily determined by reference to one or more of the measuring scales 42*b*.

The carriage 44 is provided with end pieces 44*a* and 44*b* which overlap the flanges 36*c* and 38*c* respectively, as best seen in FIG. 4. The central portion of the carriage 44 includes a frame holding a transparent plate 46 made of glass, plexiglass, or other transparent material. A hairline reference marker 48 is etched, or otherwise marked, on the plate 46, and is oriented perpendicular to the track system. Thus, the measuring scales 42*b* as well as the indicator 40 are visible through the plate 46, and the position of the reference marker 48 may be compared to the measuring scales as well as the indicator.

An additional way is provided by a groove 50 along the leading edge of the base 14. A horizontal scale 52 is constrained to movement along the base 14 by a tongue 53 riding in the groove 50. This sliding scale 52 features a horizontal measuring scale 52*a* which may be used for marking off or otherwise measuring distances on the working surface perpendicular to the direction A-B along which the base 14 is constrained to move.

The scale 42 may be removed from the base 14 by sliding the scale, in either direction, out of the grooves 36*b* and 38*b*. Then, another scale, with different measuring scales 42*b*, may be inserted through the ends of the grooves 36*b* and 38*b*, and positioned along the base 14 as needed. In this way, any number of different types of measuring scales 42*b* may be provided for use with the scaling parallel bar of the present invention. Similarly, the horizontal scale 52 may be lifted from the groove 50 and replaced with a similar element having a different horizontal measuring scale 52*a*.

The scaling parallel bar of the present invention may be used as follows. Once the direction along the working surface 12 along which distances are to be determined has been identified, the guide system is adjusted. The sheaves 28 and 30 are positioned and the line segments 24 and 26 are anchored at points 24*a* and 26*a*, respectively. The line segments 24 and 26 are adjusted relative to the working surface 12, and the clip 34 further anchors the line segment 12 to constrain the base 14 to translational motion along the preselected direction A-B. The base 14 is then positioned at whatever reference location along the direction A-B may be used as a starting position. The scale 42 is moved along the base 14 until a "0" point, or other reference point, on a measuring scale 42*b* coincides with the location of the indicator 40. It will be appreciated that the measuring scales 42*b* may be provided with more than one "0" point each to accomodate this staring point of the indicator 40 being at virtually any position along the base 14. For example, with a base 14, say, thirty-eight inches long, a measuring scale 42*b* may be three feet long, with a total of four "0" points, including both ends of the measuring scale. The carriage 44 may then be moved along the base 14 until the reference marker 48 is alligned with the point on the measuring scale 42*b* corresponding to the new position along the direction A-B to which the base 14 is to be moved. Thus, for example, if eight inches are to be measured along the working surface 12 in the sense indicated by the arrow A, and the "0" point of the chosen reference scale 42*b* is alligned with the indicator 40, then the reference marker 48 is placed over the eight inch mark of the selected measuring scale. The base 14 is then moved along the direction A-B in the sense of the arrow A until the indicator 40 is alligned with the reference marker 48. Then, the base 14 will have been moved along the working surface 12 a distance of eight inches.

Measurements may be made in the opposite sense along the direction A-B as indicated by the arrow B. A reference point on an appropriate measuring scale 42*b*is lined up with the indicator 40, and the distance the base 14 is to be moved is measured along the measuring scale 42*b* by moving the reference marked to the left the indicated distance. The base 14 is moved along the direction A-B in the sense indicated by the arrow B until the indicator 40 is once again alligned with the reference marker 48.

Distances along the direction A-B may also be measured by use of the scaling parallel bar of the present invention by first alligning an edge of the base 14 with a predetermined starting point on the working surface 12. A "0" point, or other reference mark, on a measuring scale 42b is then aligned with the indicator 40, and the base 14 is moved to the second point on the working surface 12. The distance the indicator 40 is moved along the measuring scale 42b during the movement of the base 14 is noted as equal to the distance the base 14 has been moved.

It will be appreciated that the scaling parallel bar of the present invention may be employed to determine distances in either sense, as indicated by arrows A and B, along a direction on a plane or working surface 12. Distances may be determined by marking off or measuring selected distance values along a direction on a working surface and distances between points along a direction on a working surface may be so measured. Furthermore, a horizontal sliding scale 52 is provided whereby distances perpendicular to the aforementioned direction A-B may be measured.

Variations in the construction and method of use of the scaling parallel bar of the present invention may also be employed within the spirit of the invention. Thus, for example, the spring 32 may be replaced by some other type of resilant shock-absorbing device such as a fluid pressure piston-and-cylinder assembly. Also, such a device as the spring 32 may be eliminated entirely, and lines 24 and 26 may be simply different segments of a single continuous line. Further, a pair of scaling parallel bars according to the present invention may be provided on a single working surface 12, with the second parallel bar installed to determine distances along a direction perpendicular to that indicated by arrows A and B. Thus, as viewed in FIG, 1, one base 14 may be provided and oriented as shown, and a second base, with accompanying guide system, may be installed to move laterally across the working surface 12. To facilitate such movement by the individual bases, one such base would be moved to a position at either edge of the working surface 12 while the other base is in immediate use.

The foregoing disclosure and description of the invention is illustrative and explanatory thereof, and various changes in the method steps as well as in the details of the illustrated apparatus may be made within the scope of the appended claims without departing from the spirit of the invention.

I claim:

1. A parallel bar for use with a planar working surface comprising:

(a) an elongate base;

(b) guide means, for constraining said base to translational motion along a direction on said surface, said direction generally perpendicular to the longitudinal axis of said base means, said guide means including:

(i) a first pair of sheaves mounted on said base means toward one end thereof;

(ii) a second pair of sheaves mounted on said base means toward a second end thereof;

(iii) flexible line means including a first line segment passing around one sheave of said first pair of sheaves, along said base and around one sheave of said second pair of sheaves, and a second line segment passing around the other sheave of said first pair of sheaves, along said base and around the other sheave of said second pair of sheaves; and (iv) anchor means for anchoring said flexible line means relative to said surface whereby, as said base is selectively moved along said direction in either sense thereof, said first and second line segments move generally along said base, between said first and second pairs of sheaves;

(c) first way means, as part of said base;

(d) indicator means constrained to movement relative to said base along said first way means, and connected to one of said first or second line segments with which said indicator means moves along said base, and between said first and second pair of sheaves, as said base is moved along said direction in either sense thereof;

(e) second way means and third way means, each as part of said base and generally parallel to said first way means, said second way means being disposed generally between said first and third way means, and on a plane above said first and second pair of sheaves relative to said working surface;

(f) scale means, at least partially transparent, selectively moveable along said second way means, and selectively removeable therefrom; and (g) carriage means, at least partially transparent, and including reference means, and selectively moveable along said third way means.

2. A parallel bar as defined in claim 1 wherein said scale means includes a plurality of measuring scales.

3. A parallel bar as defined in claim 1 wherein:

(a) said first way means comprises a pair of opposed grooves;

(b) said second way means comprises a pair of opposed grooves; and (c) said third way means comprises a pair of flanges.

4. A parallel bar as defined in claim 3 wherein said scale means includes a plurality of measuring scales.

5. A parallel bar as defined in claim 1 wherein said indicator means is moveable between said surface and said scale means.

6. A parallel bar as defined in claim 1 wherein said scale means includes a plurality of measuring scales.

7. A parallel bar as defined in claim 1 wherein:

(a) said first way means comprises a pair of opposed grooves; and (b) said second way means comprises a pair of opposed grooves positioned so that said first way means is generally between said surface and said second way means.

8. A parallel bar as defined in claim 7 wherein said third way means comprises a pair of flanges positioned so that said scale means is moveable between said surface and said reference means.

9. A parallel bar as defined in claim 7 wherein said scale means includes a plurality of measuring scales.

10. A method of determining distances along a direction in a plane comprising the steps of:

(a) positioning a parallel bar at a first location from which a distance along said direction is to be determined, said parallel bar lying on said plane, and oriented generally perpendicular to said direction;

(b) positioning a scale, selectively moveable along said parallel bar, with a reference point along said scale aligned with an indicator connected to a flexible line anchored relative to said plane and movable along said parallel bar as said parallel bar is moved along said direction directing whereby said indicator is moveable along said parallel bar, generally parallel to and below said scale, in proportion to movement of said parallel bar along said direction;

(c) positioning a reference marker, selectively moveable along said parallel bar generally parallel to said scale, aligned with a position on said scale representing the distance, in relation to said reference point, to be determined along said direction in said plane; and (d) moving said parallel bar along said direction until said indicator is aligned with said reference marker, the attendant position of the parallel bar then indicating a second location which is at the distance, in relation to said first location, to be determined along said direction.

* * * * *

UNITED STATES PATENT AND TRADEMARK OFFICE

CERTIFICATE OF CORRECTION

PATENT NO. : 4,170,825

DATED : October 16, 1979

INVENTOR(S) : Dudley W. Russell

It is certified that error appears in the above-identified patent and that said Letters Patent are hereby corrected as shown below:

In Claim 6, Column 6, line 42, delete the number "1" and insert therefor --5--.

Signed and Sealed this

*Ninth* Day of *June 1981*

[SEAL]

*Attest:*

RENE D. TEGTMEYER

*Attesting Officer*

*Acting Commissioner of Patents and Trademarks*